US006311585B1

(12) United States Patent
Jamra et al.

(10) Patent No.: US 6,311,585 B1
(45) Date of Patent: Nov. 6, 2001

(54) FLOW REGULATION DEVICE

(75) Inventors: James A. Jamra; Peter A. Rosa, both of Madison; Marvin W. Burkhalter, III, Mystic, all of CT (US)

(73) Assignee: Titan Technologies International, Inc., Madison, CT (US)

( * ) Notice: Subject to any disclaimer, the term of this patent is extended or adjusted under 35 U.S.C. 154(b) by 0 days.

(21) Appl. No.: 09/825,528

(22) Filed: Apr. 3, 2001

Related U.S. Application Data

(62) Division of application No. 09/643,284, filed on Aug. 22, 2000.

(51) Int. Cl.[7] ..... B25B 13/46
(52) U.S. Cl. ..... 81/57.39; 81/57.44; 81/60
(58) Field of Search ..... 81/57.39, 57.44, 81/60, 61

(56) References Cited

U.S. PATENT DOCUMENTS 5,495,782 * 3/1996 Ruessmann et al. ..... 81/57.39
5,515,753 * 5/1996 Wagner et al. ..... 81/57.39
5,953,967 * 9/1999 Junkers et al. ..... 81/57.39
6,112,622 * 9/2000 Reiman ..... 81/57.39
6,223,836 * 5/2001 Turoff ..... 173/218

* cited by examiner

*Primary Examiner*—Joseph J. Hail, III
*Assistant Examiner*—David B. Thomas
(74) *Attorney, Agent, or Firm*—Bachman & LaPointe, P.C.

(57) ABSTRACT

The present invention relates to a flow regulation device for mitigating over travel of a piston in a fluid operated tool. The flow regulation device includes a flow channel through which flows an operating fluid to be supplied to operate the piston within the tool and a movable flow restrictor within the flow channel. The flow restrictor has an internal fluid passageway for regulating the flow rate of the operating fluid being supplied to the tool to operate the piston. The flow restrictor also has a frustoconical portion which mates or seats against a portion of the flow channel as fluid is being supplied to operate the piston. A spring is provided to insure that the frustoconical portion seats against the mating portion of the flow channel. When the piston is retracted and operating fluid is being returned to a supply, the force applied by the spring is overcome and the flow restrictor is moved so that the frustoconical portion is unseated from the mating portion.

5 Claims, 2 Drawing Sheets

FLOW REGULATION DEVICE

This is a Division of application Ser. No. 09/643,284, filed Aug. 22, 2000.

BACKGROUND OF THE INVENTION

The present invention relates to an improved flow regulation device, which has particularly utility in fluid operated tools.

Fluid operated tools are known in the art. For example, U.S. Pat. No. 5,005,447 to Junkers; U.S. Pat. No. 5,140,874 to Junkers; U.S. Pat. No. 5,499,558 to Junkers; and U.S. Pat. No. 5,924,340 to Junkers; and U.S. Reissue Pat. No. 33,951 illustrate known fluid operated tools. In these tools, hydraulic fluid or oil is typically used as the operating fluid.

With the employment of hydraulics to generate forces to perform work, over-travel can occur that potentially causes damage to the tool, thus limiting tool longevity. In the case of hydraulic torque wrenches, the piston being driven by oil pressure will translate the forces from the oil build up of pressure against the ratchet via the drive pawl, thus creating high torque levels to break nuts free. When the holding torque is overcome, the nut breaks free. This allows the piston still being driven by high oil pressure to lunge forward. Due to internal space limitations, the piston will then collide with the inside surface of the tool, e.g. shroud or housing, thus potentially causing damage to the piston head and/or the housing or shroud.

SUMMARY OF THE INVENTION

Accordingly, it is an object of the present invention to provide a flow regulation device to be used with fluid operated tools.

It is a further object of the present invention to provide a flow regulation device as above which mitigates piston over-travel in fluid operated tools.

It is yet a further object of the present invention to provide a flow regulation device as above for use with a fluid operated tool for breaking nuts, which device bleeds off an operating fluid under high pressure, as a nut breaks free.

The flow regulation device of the present invention attains the foregoing objects.

In accordance with the present invention, a flow regulation device for use with a fluid operated tool broadly comprises a flow channel through which flows an operating fluid to be supplied to operate a piston within the tool and a flow restrictor within the flow channel. The flow restrictor has an internal fluid passageway or flow channel, which regulates the flow rate of the operating fluid being supplied to operate the piston.

Other details of the flow regulation device of the present invention, as well as other objects and advantages attendant thereto, are set forth in the following detailed description and the accompanying drawings in which like reference numerals depict like elements.

DETAILED DESCRIPTION OF THE PREFERRED EMBODIMENT(S)

Figure 1:
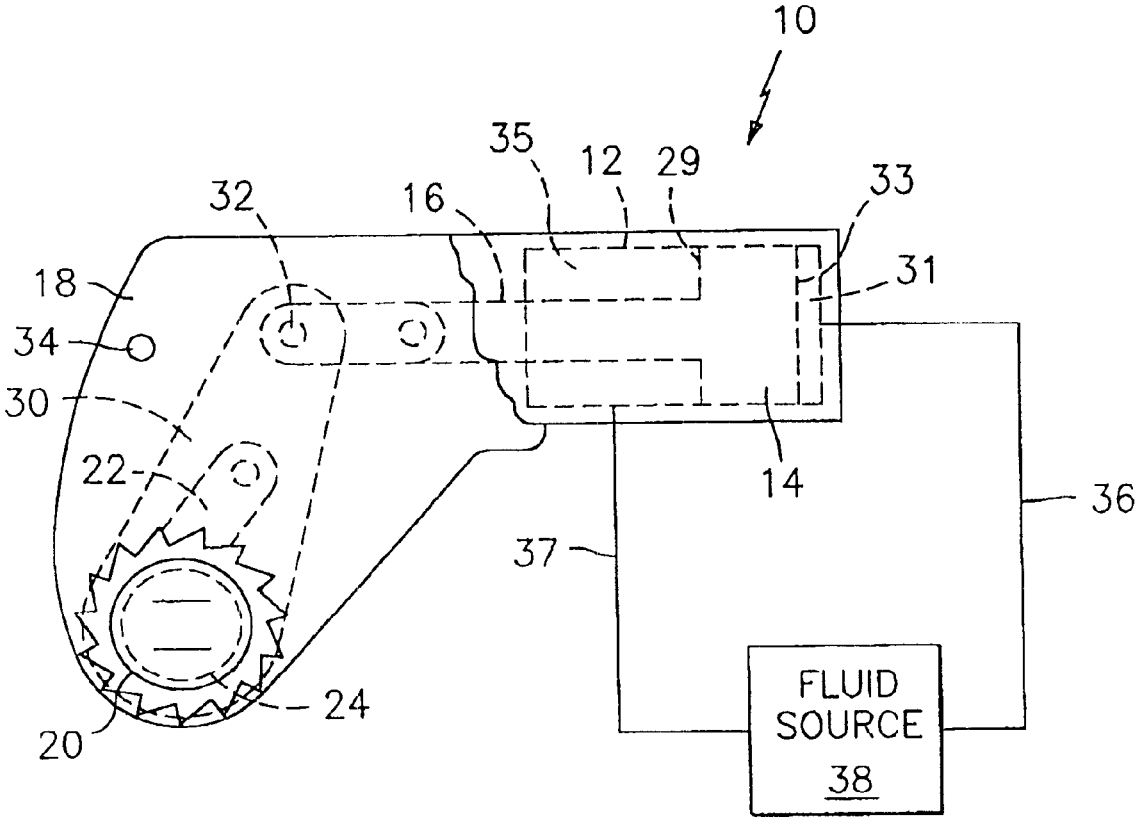
FIG. 1 is a view showing schematically a fluid operated tool.

Referring now to FIG. 1, a fluid operated wrench 10 is illustrated. As shown therein, the wrench 10 has a drive, which includes a cylinder 12 and a piston 14 movable in the cylinder 12 and provided with a piston rod 16. One or more side plates 18 are connected in a known manner with the cylinder 12 of the drive and form together with the cylinder 12 a housing for the tool.

The wrench 10 further has a ratchet pawl mechanism which includes a ratchet 20 and a pawl 22 engaging one another through respective teeth. The ratchet 20 is provided with an inner opening 24. The opening 24 is preferably non-round and its wall has a plurality of engaging formations, for example splines. The pawl 22 is rotatably mounted on a pin, which is held in two or more drive plate(s) 30 or within one integral drive plate. The drive plates 30 surround the pawl 22 on both opposite sides and are sandwiched between the side plates 18. The upper ends of the drive plate(s) 30 are pivotally connected with the end of the piston rod 16 of the drive, for example by a pin 32. The side plates 18 are also connected with one another for example by a pin 34, or designed (incorporated into) as a one piece housing.

An operating fluid such as hydraulic fluid or oil under pressure is supplied to a first chamber 31 formed by the cylinder 12 and a drive side 33 of the piston 14 via a flow line 36 and to a second chamber 35 formed by the cylinder 12 and a retraction side 29 of the piston 14 via a flow line 37. The flow lines 36 and 37 communicate with a source 38 of operating fluid.

As the operating fluid is injected into the tool 10 via flow line 36, fluid pressure builds and the piston 14 is in a driving mode. This translates the piston 14, which in turn engages the drive pawl 22 into a ratchet spline. The ratchet spline, in turn, rotates about its axis, thus generating a torque about the tightened nut by way of an appropriate drive socket (not shown).

Figure 2:
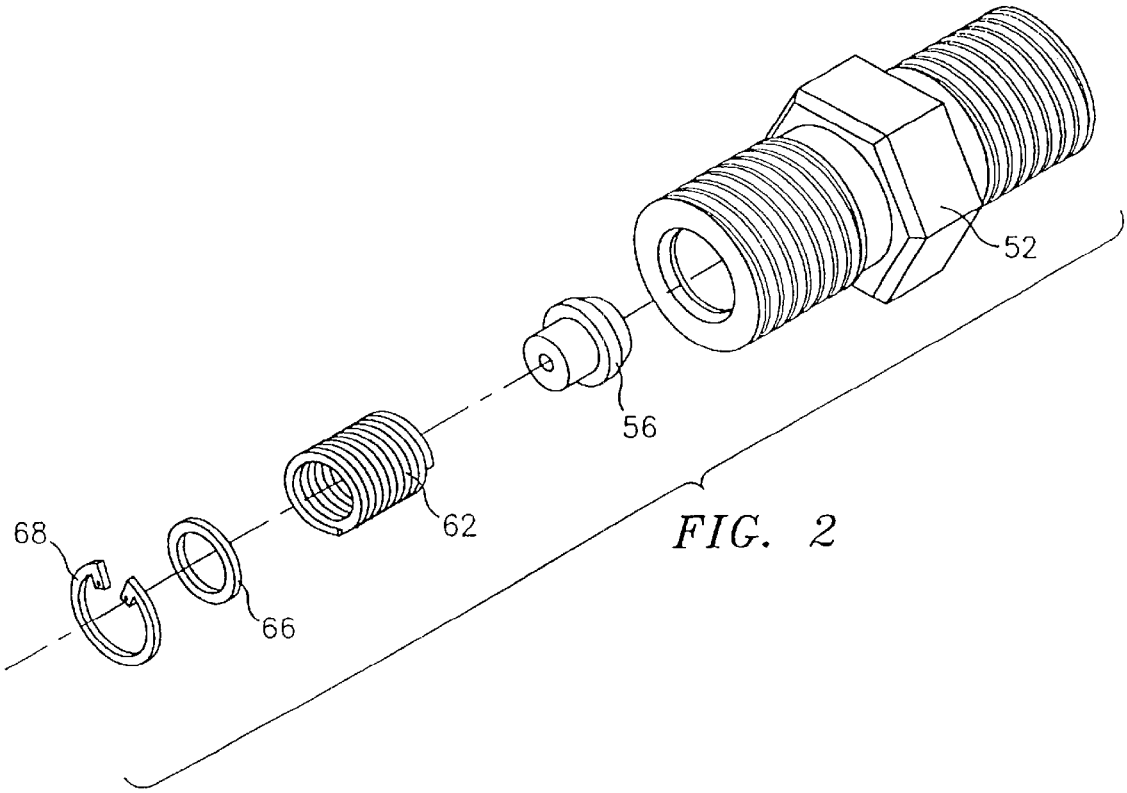
FIG. 2 is an exploded view of the flow regulation device of the present invention.
Figure 3:
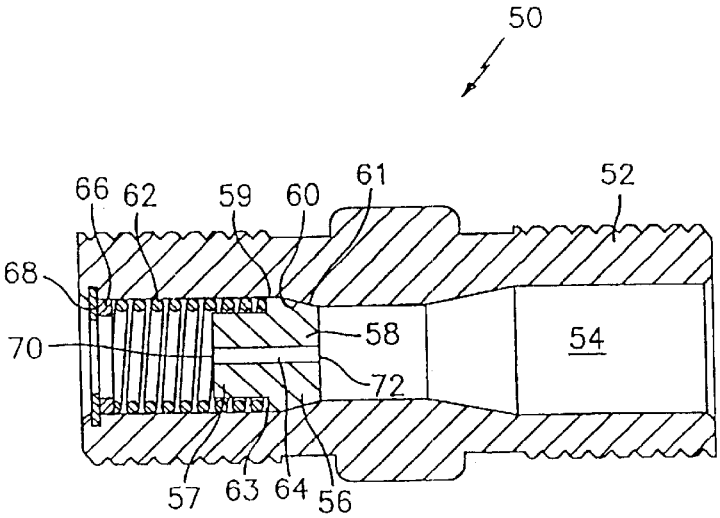
FIG. 3 is a cross sectional view of the flow regulation device of the present invention within a fluid flow channel.

To prevent over-travel by the piston 14, a fluid regulation device 50 is incorporated into the flow line 37. Referring now to FIGS. 2 and 3, the fluid regulation device 50 comprises a housing 52 with an internal flow channel 54 and a movable flow restrictor 56 within the flow channel 54. The flow restrictor 56 comprises a plunger having a base portion 57 with a first outer diameter, an integrally formed central portion 59 with a second outer diameter, and an integrally formed, tapered frustoconical portion 58 extending from the central portion 59. The outer diameter of the central portion 59 corresponds to the diameter of the flow channel 54 and is greater than outer diameter of the base portion 57. As shown in FIG. 3, during the driving mode, a surface 61 of the tapered frustoconical portion 58 is seated against a surface 60 of a mating frustoconical portion 55 of the flow channel 54.

To insure that the surface 61 of the tapered frustoconical portion 58 is seated against the mating portion 60, a spring 62. is provided. As shown in FIG. 3, the spring 62 has one end that which fits over the base portion 57 of the flow restrictor and seats against the adjacent surface 63 of the central portion 59 of the flow restrictor. A seating ring 66, such as a washer or any other device of any shape, which performs the function, is positioned adjacent the opposite end of the spring 62 to insure proper seating of the spring. A locking member or ring 68 is provided to insure that the seating ring 66 and the second end of the spring 62 are properly positioned. The locking member or ring also holds the assembly of the plunger and the spring within the housing. The locking member or ring 68 engages a groove 65 formed in the housing 52.

As shown in FIG. 3, the flow restrictor 56 has a central fluid passageway or orifice 64 extending from one end to the other end of the restrictor. The orifice 64 controls the rate of flow of the operating fluid supplied via flow line 36 to operate the piston 14.

The housing 52 may be formed from any suitable material known in the art and may be a metal coupler, which is connected in the flow line 37. The flow channel 54 in the housing 52 may have any desired configuration. For example, the flow channel 54 can have the converging—diverging portion shown in FIG. 3.

The flow restrictor or plunger 56 may be formed from any suitable metal or non-metallic material known in the art.

In operation, fluid under pressure is supplied to the drive side of the piston 14 via the flow line 36. As the outgoing fluid from the retraction side of the piston 14 reaches the flow regulation device 50 in the flow line 37, the surface 61 of the tapered frustoconical portion 58 of the plunger 56 is seated against the mating surface 60. Operating fluid then flows into the orifice 64 via opening 70, through the orifice 64, and exits from the orifice 64 via opening 72. As previously mentioned, the flow rate of the operating fluid is a function of the diameter of the central orifice 64. Thus, the flow regulation device 50 accurately controls the operating fluid pressure so that there is minimal over travel of the piston 14 once the holding torque of the nut is overcome.

During the retraction mode or stroke of the piston 14, the operating pressure of the fluid in the flow line 37 overcomes the spring force of the spring 62 and compresses the spring 62. As a result, the flow restrictor or plunger 56 moves so that the surface 61 of the tapered frustoconical portion 58 is no longer in contact with the mating surface 60, thus allowing the required fluid flow for proper retraction of the piston 14. As the operating fluid is then supplied for delivery of the next piston or drive stroke, the spring 62 tightly reseats the restrictor 56 so that the surface 61 of the tapered frustoconical portion contacts the mating surface 60. Once again, only operating fluid at a desired flow rate can bleed through the central orifice 64 to control the inertia of the piston 14.

The dampening effect created by the flow regulation device 50 of the present invention rapidly decreases the operating fluid pressure, controlling the inertia of the piston 14 in the tool, thus keeping over travel of the piston 14 to a minimum. As a result, the drive pawl 22 and the piston 14 do not collide with the internal surfaces of the shroud or tool housing. This increases overall efficiency of the tool and increases the longevity of the tool and its internal parts.

One advantage to the flow regulation device of the present invention is that replacing one restrictor with another restrictor having a central fluid passageway or orifice with a larger or smaller diameter can provide different flow rates.

While the flow regulation device of the present invention has been shown as being incorporated into a retract line externally of the tool, the device could also be incorporated into a flow line within the housing of the tool. Still further, the flow regulation device of the present invention may be used with a fluid supply device such as that shown in U.S. Pat. No. 5,311,796 to Junkers, which is hereby incorporated by reference herein. In such a configuration, the flow regulation device 50 is connected to the outlet of the fluid return or retraction side of the Junkers device.

While the flow regulation device of the present invention has been described in the context of a fluid operated wrench, the flow regulation device could be used with other types of fluid operated tools.

It is apparent that there has been provided in accordance with the present invention a flow regulation device that fully satisfies the means, objects, and advantages set forth hereinabove. While the flow regulation device of the present invention has been described in the context of specific embodiments thereof, other modifications, variations, and alternatives will become apparent to those skilled in the art having read the foregoing description. Therefore, it is intended to embrace all such modifications, variations, alternatives, and alternatives, which fall within the broad scope of the appended claims.

What is claimed is:

1. A power wrench comprising:

a fluid operated drive unit for generating a torque to be applied to a mechanical element, said drive unit comprising a piston reciprocally movable within a cylinder;

said piston having a drive face and a retraction face;

a first flow line for delivering an operating fluid from a fluid source to a first chamber formed by said cylinder and said drive face of said piston;

a second flow line for delivering said operating fluid from said fluid source to a second chamber formed by said cylinder and said retraction face of said piston; and a flow regulation device in said second flow line for mitigating over travel of said piston.

2. A power wrench according to claim 1 wherein said first flow line returns fluid from said first chamber to said fluid source when said piston is in a retraction mode and said second flow line returns fluid from said second chamber to said fluid source when said piston is in a drive mode.

3. A power wrench according to claim 2, wherein said flow regulation device comprises a housing defining a fluid channel and a flow regulator within said flow channel.

4. A power wrench according to claim 3, wherein a spring holds said flow regulator in contact with a portion of said housing and wherein during said drive mode, fluid being returned to said fluid source via said second flow line flows only through an orifice in said flow regulator.

5. A power wrench according to claim 4, wherein during said retraction phase, said operating fluid flowing through said flow channel towards said second chamber has a pressure greater than the pressure applied by said spring to said flow regulator and unseats said flow regulator from said housing portion.

* * * * *